United States Patent [19]

McDougal

[11] 4,255,929

[45] Mar. 17, 1981

[54] HOT GAS ENGINE WITH DUAL CRANKSHAFTS

[76] Inventor: Robert A. Frosch, Administrator of the National Aeronautics and Space Administration, with respect to an invention of Allan R. McDougal, La Crescenta, Calif.

[21] Appl. No.: 907,431

[22] Filed: May 19, 1978

[51] Int. Cl.[3] ..... F02G 1/04

[52] U.S. Cl. ..... 60/517; 60/525

[58] Field of Search ..... 60/516, 517, 518, 521, 60/522, 525, 716; 62/6

[56] References Cited

U.S. PATENT DOCUMENTS

| | | | |
|---|---|---|---|
| 968,127 | 8/1910 | Cloud | 60/716 |
| 2,484,392 | 10/1949 | Van Heeckeren | 60/525 X |
| 3,370,418 | 2/1968 | Kelly | 60/519 |
| 3,457,722 | 7/1969 | Bush | 60/522 |
| 3,708,979 | 1/1973 | Bush et al. | 60/522 |
| 3,751,904 | 8/1973 | Rydberg | 60/525 |
| 3,777,718 | 12/1973 | Pattas | 60/517 X |
| 3,803,857 | 4/1974 | Ishizaki | 60/522 X |
| 3,812,677 | 5/1974 | Greis | 60/517 |
| 3,822,552 | 7/1974 | Palmgren | 60/517 |
| 3,845,624 | 11/1974 | Roos | 60/517 |
| 3,939,657 | 2/1976 | Postma et al. | 60/526 |
| 3,994,136 | 11/1976 | Polster | 60/518 |
| 4,019,322 | 4/1977 | Meijer | 60/526 |

*Primary Examiner*—Allen M. Ostrager
*Assistant Examiner*—Stephen F. Husar
*Attorney, Agent, or Firm*—Monte F. Mott; John R. Manning; Wilfred Grifka

[57] ABSTRACT

A hot gas engine, such as a Stirling engine, which comprises a displacer portion and an expander portion with a heat exchanger connected therebetween. The expander portion has an expander piston which is operatively connected to and rotates an expander crankshaft. In like manner, the displacer portion is provided with a displacer piston which is also operatively connected to and rotates with a separate displacer crankshaft. The two crankshafts are synchronized with respect to each other, preferably by means of an idler gear. Banks of displacer pistons can also be provided for operation on a common displacer crankshaft and banks of cooperating expander pistons also can be provided for operation on a common expander crankshaft.

16 Claims, 10 Drawing Figures

HOT GAS ENGINE WITH DUAL CRANKSHAFTS

ORIGIN OF THE INVENTION

The invention described herein was made in the performance of work under a NASA contract and is subject to the provisions of Section 305 of the National Aeronautics and Space Act of 1958, Public Law 85-568 (72 Stat. 435; 42 USC 2457).

BACKGROUND OF THE INVENTION

1. Purpose of the Invention

This invention relates in general to certain new and useful improvements in hot gas engines, and, more particularly, to hot gas engines which have a first crankshaft connected to the expander portion of the engine and a second and separate crankshaft connected to the displacer portion of the engine and which crankshafts are synchronized in operation.

2. Brief Description of the Prior Art

Hot gas engines, often referred to as "Stirling" engines, have been known for a long period of time. Generally, the Stirling engine comprises a pair of pistons, including an expander piston and a displacer piston, both of which are connected to a single crankshaft. A heat exchanger is connected between the expander portion of the engine and the displacer portion of the engine. In the expander portion of the engine, hot gas is expanded and converts heat energy into power, so that the overall engine produces a useful power output. The displacer portion of the engine utilizes some of the power from the crankshaft to compress a cooled, working gas, thereby generating a net power output from the engine.

The typical Stirling engine is constructed so that a fixed and predetermined phase angle exists between the power piston and the displacer piston in the engine. When the phase angle between the displacer piston and the power piston is 0°, there is no power output from the engine. Increases in a positive direction of the phase angle between the displacer piston and the expander piston result in a net forward power output from the engine. Correspondingly, a phase angle change in the opposite direction results in a net reverse power output. Thus, at a full 90° phase angle difference between the expander piston and the displacer piston, full forward power is obtained, and with a −90° phase angle between the expander piston and the displacer piston, full reverse power is obtained from the engine. In this way, it is possible to control the engine's power output and also to change the output to a forward or reverse direction. However, in each of the prior art devices, the displacer piston and the expander piston operated on a common crankshaft and a complex system was required to change the phase between the displacer portion and the expander portion.

It had previously been assumed that the expander piston and the displacer piston must be connected to a common crankshaft in order to obtain efficiency of operation in a Stirling-type engine. For example, in U.S. Pat. No. 3,751,904 to Rydberg, an expander cylinder and displacer cylinder are arranged in side-by-side relationship in the same vertical plane. The expander and displacer piston rods are connected to a common crankshaft through a rather complex linkage arrangement, including crank elbows. In U.S. Pat. No. 3,939,657 to Postema et al., a Stirling engine is provided in which the expander and displacer pistons are connected to a swash plate. The swash plate is, in turn, operatively connected to a power output shaft providing power to the output shaft. In U.S. Pat. No. 4,019,322 to Meijer, a Stirling engine is disclosed in which the cylinders, such as the expander cylinder and the displacer cylinder, are mounted in side-by-side relationship. The pistons in each of these cylinders are connected to a common swash plate and provide power to an output shaft. Moreover, phase angle displacement between the pistons is accomplished by displacement of the swash plate. In U.S. Pat. No. 2,484,392 to Van Heeckeren, a Stirling engine is also provided in which the cylinders, such as the expander cylinders and the displacer cylinders, are mounted in side-by-side relationship. Again, the pistons of these cylinders are connected to a common shaft by means of a conventional piston rod assembly.

The existing hot gas engine, such as the Stirling engine, have not received widespread consideration as a power source in vehicles requiring compact engine design, as for example, automobiles and similar vehicles, due to the size and shape of the typical Stirling engine. The Stirling engine is relatively high compared to its width and length. Therefore, any vehicle using the Stirling engine as a power source must have an engine compartment especially designed to accommodate this type of engine configuration, and the engine compartments in most vehicles, such as automobiles, are not adapted to contain a typical Stirling engine.

OBJECTS OF THE INVENTION

It is, therefore, the primary object of the present invention to provide a Stirling engine having an expander portion and a displacer portion with pistons in each of these portions connected to individual crankshafts which are synchronized for operation.

It is another object of the present invention to provide a hot gas engine of the type stated in which banks of expander pistons can be connected to a single crankshaft and banks of displacer pistons can be connected to another crankshaft, and which are synchronized for operation together.

It is a further object of the present invention to provide an engine of the type stated which can be constructed in a relatively small, compact unit.

It is an additional object of the present invention to provide a hot gas engine of the type stated which permits operation of the engine at full pressure and temperature for maximum efficiency and at any speed and power output.

It is also an object of the present invention to provide a hot gas engine of the type stated in which the engine block and the crank case and the heat exchanger can be operated at the same pressure.

It is also an object of the present invention to provide a hot gas engine with means for eliminating all gyroscopic reactions which would otherwise be generated by the engine.

With the above and other objects in view, my invention resides in the novel features of form, construction, arrangement and combination of parts presently described and pointed out in the claims.

BRIEF SUMMARY OF THE DISCLOSURE

This invention relates in general to hot gas engines, such as those engines referred to as the "Stirling" engine, which include an expander portion and a displacer portion. The expander portion generally includes an expander cylinder with a shiftable expander piston therein and, in like manner, the engine includes a displacer cylinder with a displacer piston shiftable therein. Moreover, the expander portion and the displacer portion are connected by a suitable heat exchanger, including a heater, regenerator and cooler, which is common in hot gas engines.

The name "Stirling" engine is frequently applied to various types of regenerative engines, including both rotary and reciprocative engines, utilizing mechanisms of varying complexities and covering engines capable of operating as prime movers, heat pumps, refrigerating engines and pressure generators. However, for the purposes of this invention, it may be assumed that a Stirling engine is an engine which operates on a closed, regenerative, thermodynamic cycle. This thermodynamic cycle includes cyclic compression and expansion of a working fluid at different temperature levels, and where the fluid is controlled by volume changes, so that there is a net conversion of heat to work or vice versa. Generally, the definition as applied to this type of Stirling engine is more fully discussed in "Stirling Cycle Machines", by G. Walker, Clarendon Press, Oxford, 1973.

As indicated previously, the Stirling engine, as representative of the hot gas engine, is considered as having a displacer piston and an expander piston, which are both connected to a single crankshaft with a heat exchanger, including a heater, regenerator and cooler, connected therebetween. However, in the case of the present invention, it has been found that the Stirling engine can be efficiently operated with the expander piston and the displacer piston connected to individual crankshafts which are referred to as an "expander" crankshaft and as a "displacer" crankshaft.

In the expander portion of the Stirling engine, hot gas is expanded and converts heat energy into work, so that the overall engine produces useful power to be used in operating other apparatus. The displacer portion utilizes some of the power from the crankshaft in a conventional Stirling engine to compress a cooled working gas with a resultant net output power from the engine.

In the case of the present invention, the two individual crankshafts, which generally rotate at simultaneous speeds, are synchronized in their operation by means of idler gears which cooperate with the two crankshafts. Each piston in the Stirling engine, including the displacer piston, is provided with a displacer piston rod, and the expander piston is provided with an expander piston rod. The piston rod for each of these pistons is rigidly secured to the piston and the lower end of the piston rods are connected to individual cross-heads. A connecting arm is also pivotally connected to each of the cross-heads and a crank arm is pivotally connected to the other end of the connecting arms. A portion of the connecting arm, the crank arm and crankshaft are located in a crankcase.

In a preferred embodiment, each crankshaft is provided with individual gears which in turn mesh with an idler gear. A power output shaft is connected to and is rotatable with the idler gear. However, the gears on each of the crankshafts could be disposed in meshing engagement to operate a power output shaft extending from one of the crankshafts. In this way, synchronization of speeds between the expander portion of the engine and the displacer portion of the engine is provided.

The piston rods in each portion of the engine terminate at and are connected to the cross-heads which are located within cylinder skirt portions at the lower ends of the cylinders in order to reduce side load effects. The cross-heads have portions which engage the side wall of the cylinder skirt portions and thereby transmit radial or transverse forces to the engine block. Conventional sealing blocks are also located within the skirt portions of the cylinders immediately above the cross-heads and receive the pistons in their reciprocative shiftable movement. The sealing blocks are designed to prevent crankcase oil from passing into the upper portion of the engine block, and, more particularly, into the heat exchanger system. One of the unique aspects of the engine is that the engine block and the heat exchanger, and even the crankcase, can be operated at the same pressure. Due to the fact that two individual crankshafts are utilized, the crankcase can adopt more of a cylindrical shape with a design capable of withstanding the pressures encountered in hot gas engines.

By virtue of utilizing two individual crankshafts, high power multi-piston engines can be constructed with banks of displacer pistons operating on a common displacer crankshaft, and with expander pistons operating on a common but separate expander crankshaft. This design inherently produces a compact and rigid hot gas engine construction. In addition to the above, the power output and direction of rotation of the engine, that is, the forward and reverse directions provided by the power output shaft, can be easily controlled by adjusting the phase angle between the two crankshafts. One means of providing the phase angle between the two crankshafts includes a differential-type gear arrangement as disclosed in co-pending application Ser. No. 907,421, filed May 19, 1978, for Power Control for Stirling Engines.

In addition to the above, the Stirling engine of the present invention can be constructed with the banks of expander pistons operating on an expander crankshaft and the banks of displacer pistons operating on a displacer crankshaft in the manner as described. In this way, modules of a basic engine component can be assembled in such a way that a very compact but yet high-powered hot gas engine can be achieved.

The present invention also provides embodiments of the Stirling engine in which the individual but similar crankshafts, namely the expander crankshaft and the displacer crankshaft, can rotate in opposite directions, if desired. This rotation of the similar crankshafts in opposite directions and at the same rate of speed substantially, if not completely, balances out the gyroscopic forces. This substantial reduction or elimination of gyroscopic forces is important when the engine is used in certain applications, as for example, in a vehicle, since the presence of the gyroscopic forces can materially affect the maneuverability of the vehicle.

This invention possesses many other advantages, and has other purposes which may be made more clearly apparent from a consideration of forms in which it may be embodied. These forms are shown in the drawings accompanying and forming part of the present specification. They will now be described in detail, for the purpose of illustrating the general principles of the invention; but it is to be understood that such detailed descriptions are not to be taken in a limiting sense.

BRIEF DESCRIPTION OF THE DRAWINGS

Figure 1:
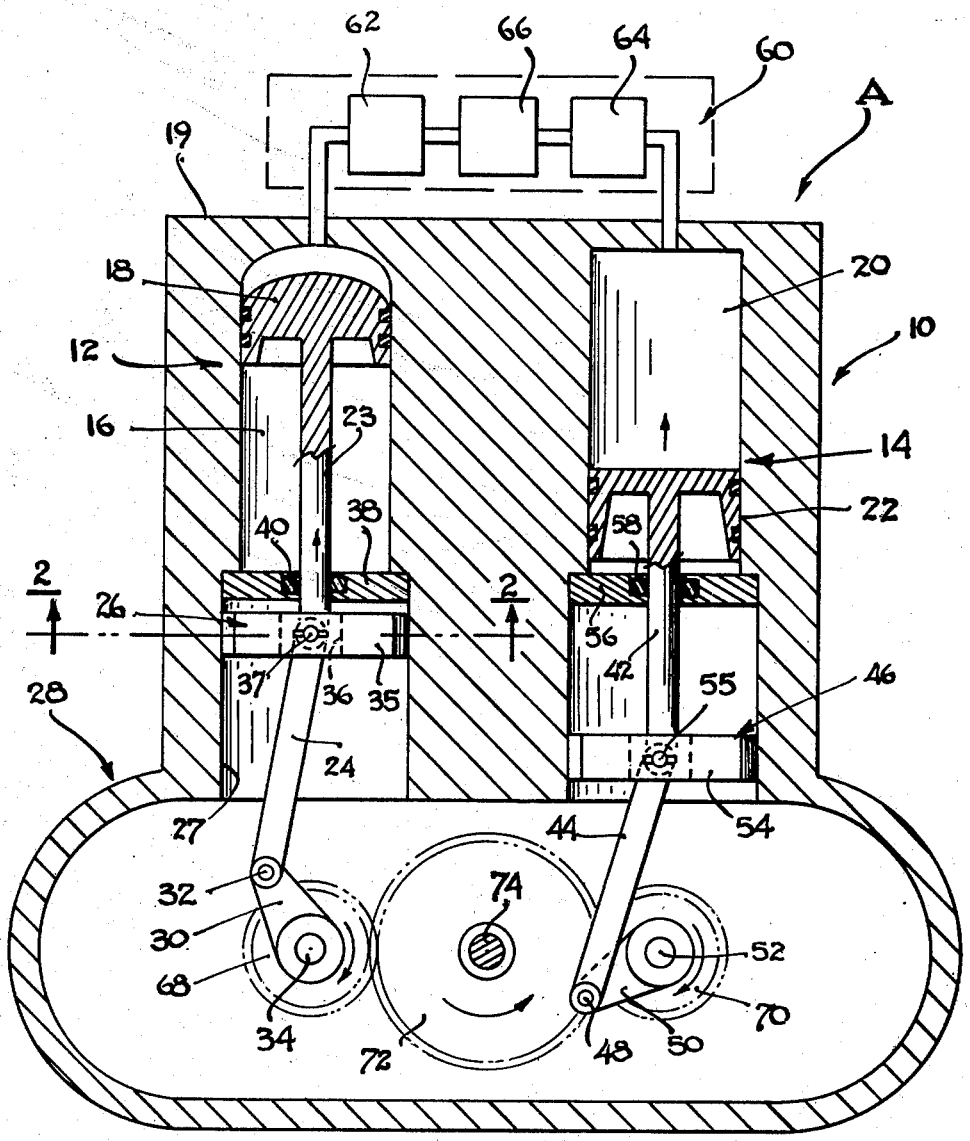
Figure 3:
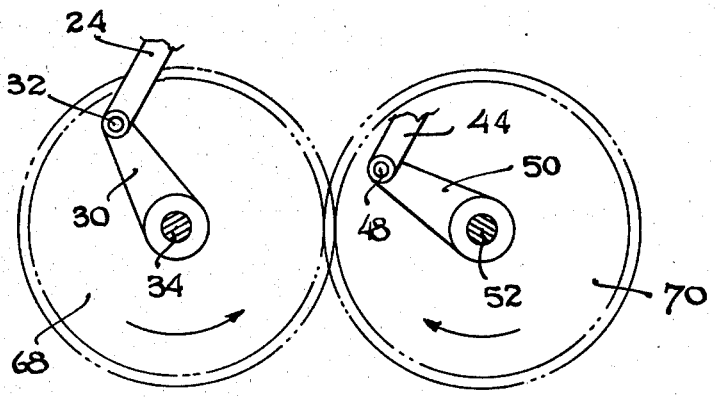
Figure 4:
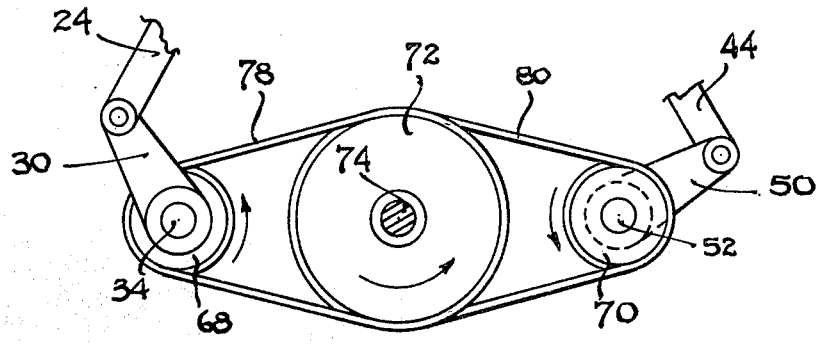
Figure 5:
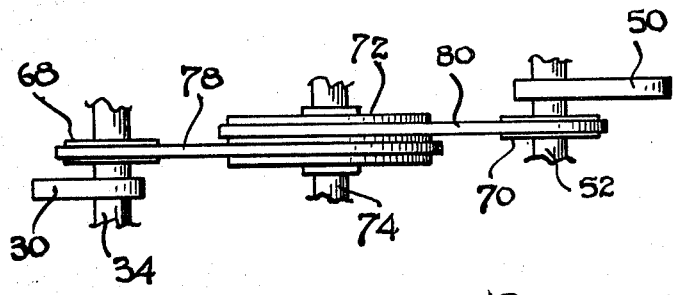
Figure 2:
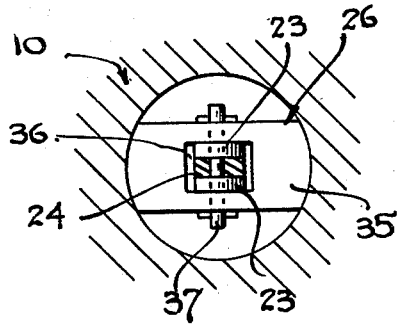
Figure 6:
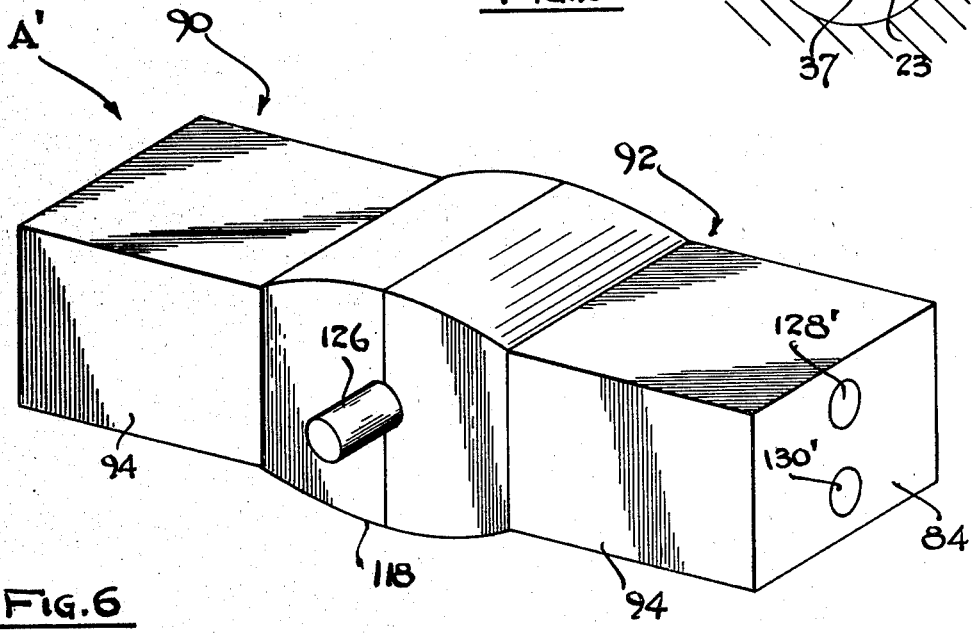
Figure 7:
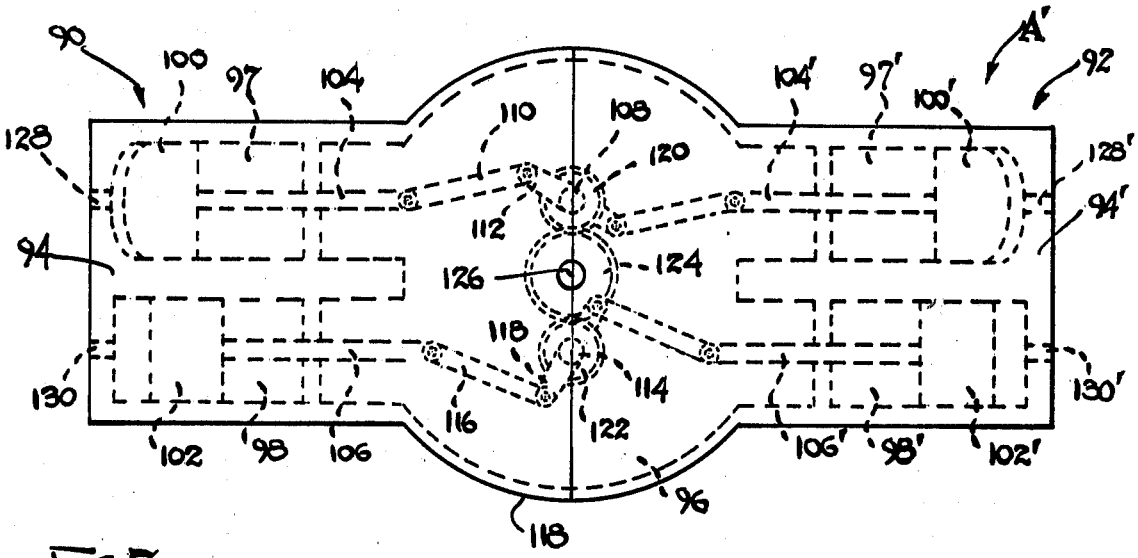
Figure 8:
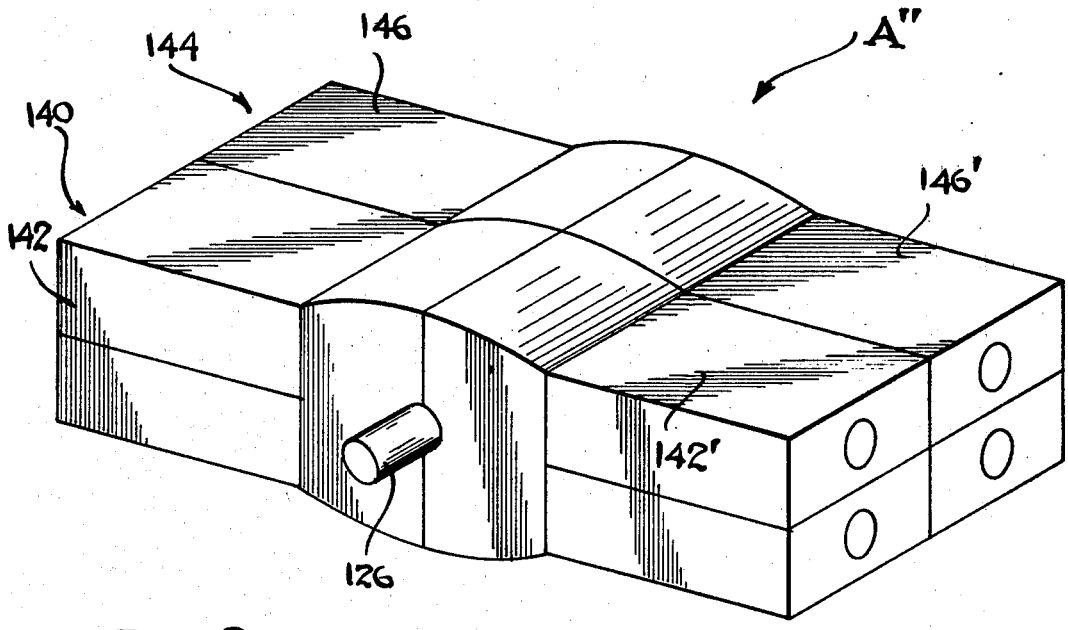
Figure 9:
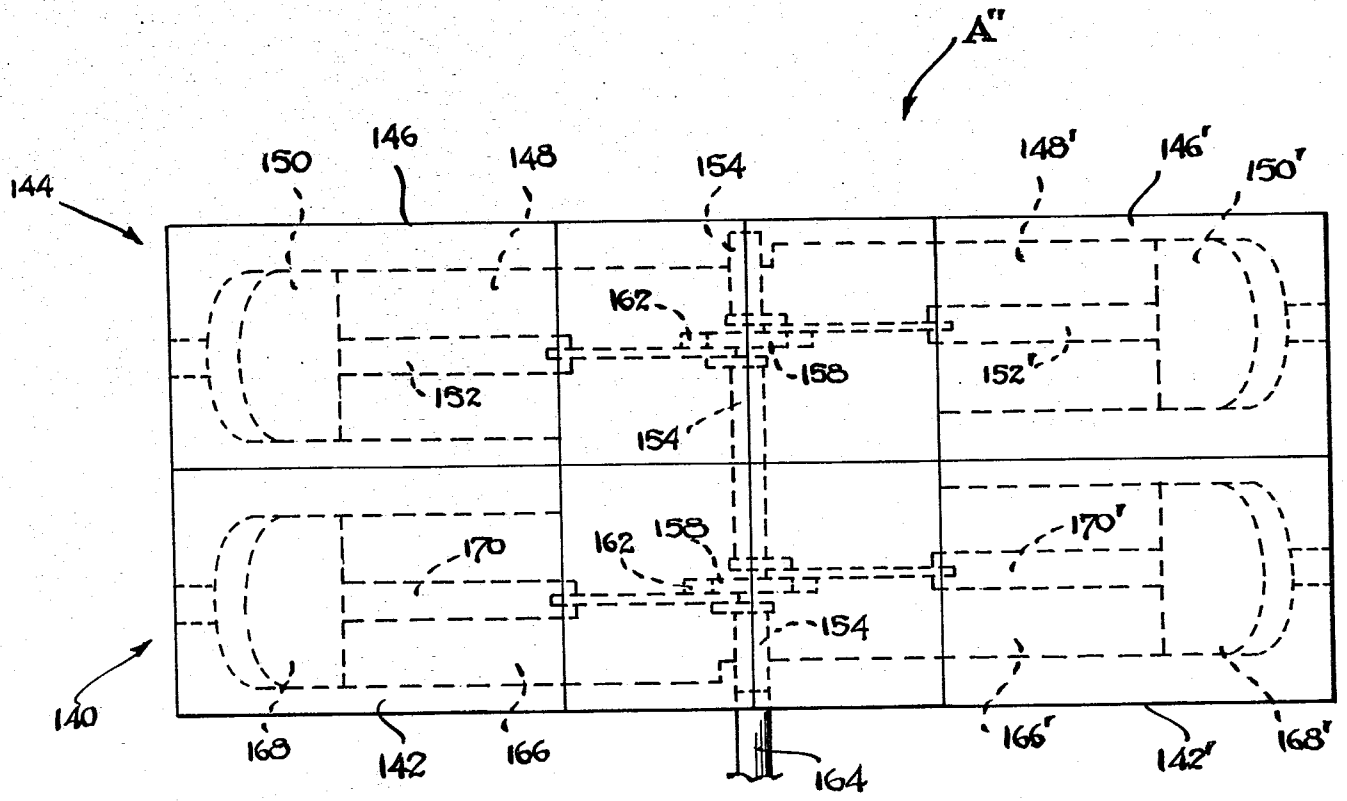
Figure 10:
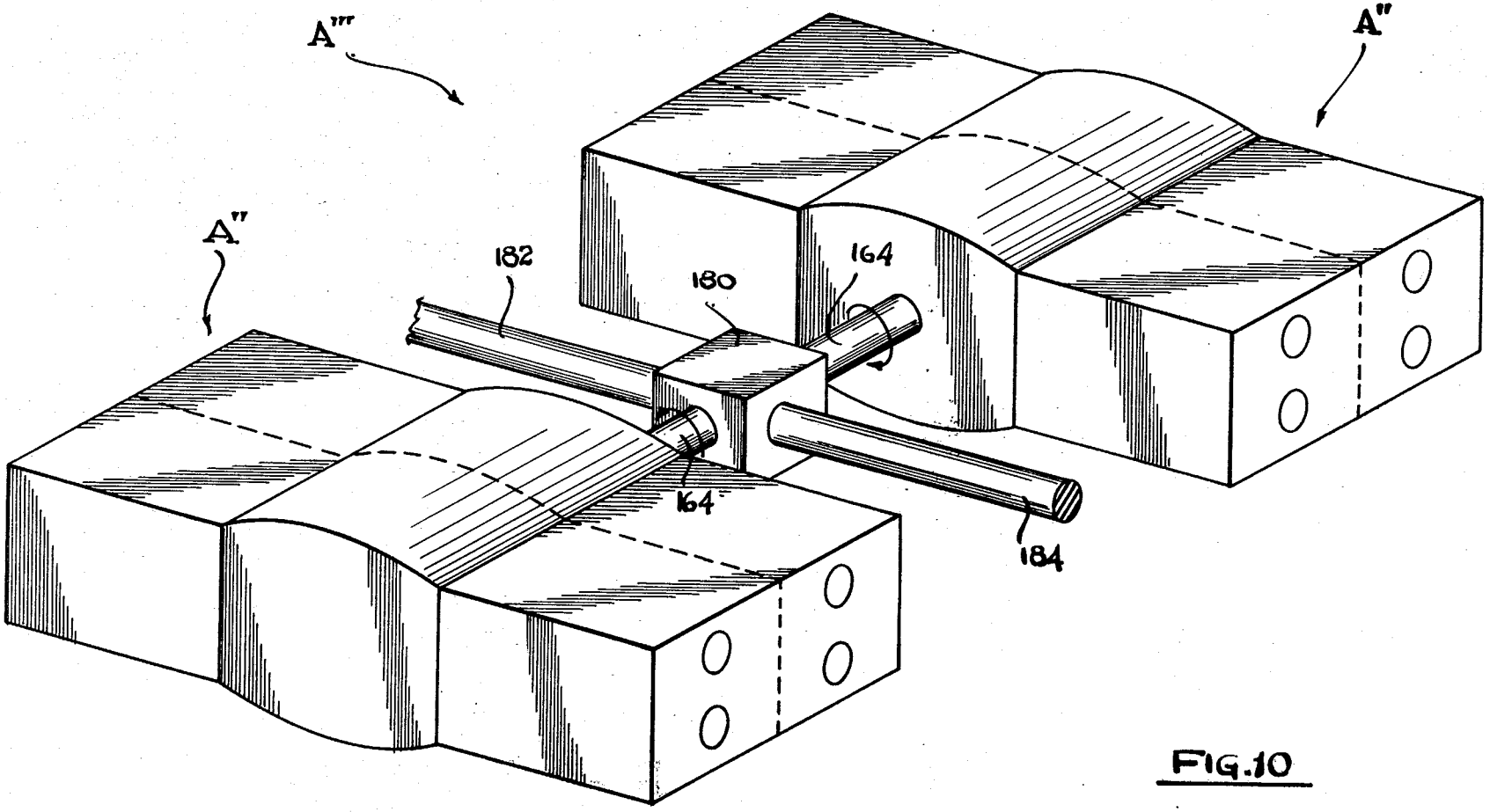

Having thus described the invention in general terms, reference will now be made to the accompanying drawings in which:

FIG. 1 is a schematic vertical sectional view of a Stirling engine having two crankshafts, constructed in accordance with and embodying the present invention;

FIG. 2 is a vertical sectional view, taken along line 2—2 of FIG. 1;

FIG. 3 is a fragmentary side elevational view, partially broken away, and showing a modified form for synchronizing two crankshafts in accordance with the present invention;

FIG. 4 is a side elevational view, partially broken away, and showing another modified form of synchronizing two crankshafts in accordance with the present invention;

FIG. 5 is a plan view of the means as shown in FIG. 4 for synchronizing two crankshafts;

FIG. 6 is a schematic perspective view of a dual unit Stirling engine constructed in accordance with and embodying the present invention;

FIG. 7 is a side elevational view, with details partially shown in dotted lines, of the dual unit Stirling engine of FIG. 6;

FIG. 8 is a schematic perspective view of a four unit Stirling engine constructed in accordance with and embodying the present invention;

FIG. 9 is a top plan view, with details partially shown in dotted lines, of one of the banks of the four unit Stirling engine of FIG. 8; and FIG. 10 is a schematic illustration of an eight unit Stirling engine constructed in accordance with and embodying the present invention.

DETAILED DESCRIPTION OF PREFERRED EMBODIMENTS

Referring now in more detail and by reference characters to the drawings which illustrate preferred embodiments of the present invention, A designates a Stirling engine in accordance with the present invention and which includes an engine block 10, having an expander portion 12 and a displacer portion 14. In this embodiment of the invention, the expander portion 12 and the displacer portion 14 include a single piston in each of the portions.

The expander portion 12 includes an expander cylinder 16 in the engine block 10 and having an expander piston 18 reciprocatively shiftable therein. In like manner, the displacer portion 14 includes a displacer cylinder 20 in the block 10 and having a displacer piston 22 reciprocatively shiftable therein. The expander piston 18 is provided with an expander piston rod 23 which is integral with or otherwise rigidly secured to the piston 18. The piston rod 23 is operatively connected at its lower end to a connecting arm 24, or so-called "connecting rod" through a cross-head 26. The cross-head 26 is located in a skirt portion 27 forming a lower end of the cylinder 20.

The connecting arm 24 extends through the lower end of the engine block 10 and into a crankcase 28 mounted at the lower end of the block 10. At its lower end, the connecting arm 24 is pivotally connected to a crankarm 30 through a pin 32, in the manner as illustrated in FIG. 1 of the drawings. The crank arm 30 is operatively connected to and rotates an expander crankshaft 34.

The cross-head 26 is provided to remove side loads from the piston rod 23 and also maintain axial alignment of the piston rod 23. The cross-head 26 is of conventional construction and in the embodiment as illustrated adopts the form of a block 35 disposed within the cylinder skirt portion 27. The block 35 is provided with a central bore 36 to receive the lower end of the piston rod 23 and the upper end of the connecting arm 24 which are connected together by a pivot pin 37. Side portions of the block 35 are cut-away so that the cross-head will not function as a piston as illustrated in FIG. 2. Due to the fact that the cross-head 26 reciprocates axially with the piston rod 23 and engages the wall of the cylinder skirt section 27, all transverse forces are transmitted to the engine block 10. Thus, the piston rod 23 and the piston 18 transfer only axial force components. In this respect, it should be understood that the cross-head could be located in the crankcase 28.

A conventional seal block 38 having a sealing ring 40 is located in the skirt portion 27 of the cylinder 16 and the piston rod 23 extends therethrough in order to prevent oil in the crankcase 28 from passing into the cylinder and into the heat exchanger portion of the engine as hereinafter described. Thus, it can be observed that the cylinder skirt portion 27 is actually in communication with the crankcase 28 and could be considered to form part of the crankcase 28.

The displacer piston 22 is similarly provided with a displacer piston rod 42 which is connected at its lower end to a connecting arm, or so-called "connecting rod", 44 through a cross-head 46. Again, the connecting arm 44 is connected at its lower end through a pivot pin 48 to a crankarm 50 which is operatively connected to, and is rotatable with a displacer crankshaft 52. The displacer piston rod 42 is also integral with or rigidly secured to the displacer piston 22. The connection of the piston rod 42 and the connecting arm 44 to the cross-head 46 is the same as that for the piston rod 23, the connecting arm 24 and the cross-head 26. Again, the cross-head 46 comprises a block 54 with a pivot pin 55 connecting the connecting arm 44 and the piston rod 42 with the cross-head 46 being located within the skirt portion of the cylinder 20. The displacer piston rod 42 also extends through a sealing block 56 also having a conventional sealing ring 58 therein, much in the same manner as the expander piston rod 23 extends through the sealing block 38.

The expander portion 12 of the engine A and the displacer portion 14 of the engine A are connected by a suitable heat exchanger 60 which includes a heater 62 connected to the expander cylinder 16 and a cooler 64 connected to the displacer cylinder 20. Moreover, a regenerator 66 is interposed between the heater 62 and the cooler 64. The heat exchanger 60 is schematically illustrated, although it would operate with the engine A in the same manner as in a conventional hot gas engine.

Mounted on and being rotatable with the expander crankshaft 34 is synchronizing expander gear 68 and, in like manner, mounted on and being rotatable with the displacer crankshaft 52 is a displacer synchronizing gear 70. Each of the gears 68 and 70, which are preferably spur gears, mesh with an idler gear 72 which is mounted on a common output power shaft 74. The gears 68 and 70 are preferably of the same size and have the same number of teeth so that synchronization exists between the expander crankshaft 34 and the displacer crankshaft 52. In this way, constant synchronization is provided to the power output shaft 74 through the idler gear 72. In this respect, idler gear 72 could have any number of teeth so long as it meshes with the synchronizing gears 68 and 70 and would create no phase differential between the crankshafts 34 and 52.

Any device could be used to create a phase change between the crankshafts 34 and 52. In this respect, it should be observed that if the crankshafts 34 and 52 provide a zero phase angle between the expander piston 18 and the displacer piston 22, then a net zero power output would result from the Stirling engine. However, if positive differential phase angle is created between the expander piston 18 and the displacer piston 22, then a net power output in the forward direction would be produced in the power output shaft 74. In like manner, if a minus phase angle change is created between the expander piston 18 and the displacer piston 22, then a reverse power output would result in the power output shaft 74. If the net phase angle differential between the expander portion 12 and the displacer portion 14 is positive 90°, then the engine would have a full maximum power output and, in like manner, if the phase angle differential between the expander portion 12 and the displacer portion 14 is a minus 90°, then the Stirling engine would provide a maximum reverse power output to the power output shaft 74 in the reverse direction. A simple differential type mechanism of the type described in the aforesaid co-pending application can be utilized to create a precise phase angle control between the two crankshafts so that the engine can be continuously adjusted from full forward power to full reverse power, while the engine is running.

The seal 40 in the seal block 38 and the seal 58 in the seal block 56 are both dry seals and are designed to prevent oil seepage into the upper portion of the cylinders 16 and 20, and particularly into the heat exchanger 60. Inasmuch as the Stirling engine has no exhaust system, oil which would otherwise enter the heat exchanger 60 would tend to burn and foul-up the components of the heat exchanger 60. However, the seals used in the Stirling engine of the present invention are quite effective inasmuch as the crankcase 28 is maintained at the same pressure as the cylinders 16 and 20 and the heat exchanger 60. In this way, there is no need to employ expensive dynamic seals in order to create a large pressure differential between the cylinders (working volume) and the crankcase.

Due to the fact that dual crankshafts are employed in the present invention, the crankcase 28 can adopt a more nearly cylindrical shape which enables the crankcase to be designed to withstand the high pressures, e.g. from about 1000 psi to about 5000 psi, used in Stirling engines. With the use of the single in-line crankshaft of the type used in the prior art, the crankcase was generally designed with a relatively high and narrow configuration, and, moreover, could not be easily designed to withstand high pressures of the type used in Stirling engines. Hence, in the prior art, it was necessary to seal the crankcase from the engine block in order to maintain the crankcase at a relatively low operating pressure. Nevertheless, in the present invention, it is possible to use relatively simple dry seals of the type employed not only to prevent oil transferrence into the heat exchanger, but to maintain the entire system at the same operating base pressure.

Further, in the present invention, it is not necessary to use a crankcase which is high and narrow as in the prior art. Rather, the crankcase 28 has a dimension (as measured along the axial centerline of the displacer cylinder 20 or the expander cylinder 16, e.g., the vertical dimension) which is substantially smaller than the similar dimension of the engine block 10, as best seen in FIG. 1.

As a result of using the relatively inexpensive seals which do not require the construction to seal against a high pressure differential, less friction, and hence less heat generation, results from the shiftable movement of the piston rods 23 and 42 through the seals 40 and 58, respectively. There is generally no problem in sealing the output power shaft 74 as it passes through the crankcase 28 inasmuch as highly effective rotating shaft seals are commercially available, particularly the type of shaft seals which can be lubricated by the crankcase oil. One form of commercially effective seal around the power output shaft at the point where it exits the crankcase 28 comprises a graphite sealing ring riding on or cooperating with a polished metal face.

FIG. 3 illustrates an arrangement where the two synchronizing gears 68 and 70 can be disposed in meshing engagement, thereby eliminating the idler gear 72 and the power output shaft 74. In this case, the power output shaft could form an extension of, e.g. could be directly connected to, one of the crankshafts 34 or 52. Generally, it is preferable to have the power output shaft as an extension or connected to the expander crankshaft 34, inasmuch as the expander crankshaft 34 provides the primary source of direct power to the engine. Due to the fact that the crankshafts 34 and 52 rotate in the opposite directions, gyroscopic forces are substantially canceled. This factor is important in high speed engines in that gyroscopic forces could substantially interfere with the maneuverability of a vehicle in which the engine is used. Since the two crankshafts generally operate at the same speed for rotation and in opposite directions, the gyroscopic forces are substantially balanced or canceled out.

FIGS. 4 and 5 illustrate another means for synchronizing the two crankshafts 34 and 52 which also utilizes the idler gear 72 and the power output shaft 74. In this embodiment, the synchronizing gears 68 and 70 are not disposed in meshing engagement with the idler gear 72, but utilize a first drive belt 78, often referred to as a "cog belt", which is trained around the expander synchronizing gear 68 and the idler gear 72. In like manner, a second drive belt, or so-called "cog belt", 80 is also trained around the displacer synchronizing gear 70 and the idler gear 72. In accordance with this construction, it can be observed that the two crankshafts 34 and 52 are still synchronized much in the same manner as if the synchronizing gears 68 and 70 were disposed in meshing engagement with the idler gear 72. It should be observed that other means for synchronizing the two crankshafts 34 and 52 could be employed in connection with the present invention.

FIGS. 6 and 7 of the drawings more fully illustrate a Stirling engine A′ constructed in accordance with and embodying the present invention, and which comprises a first Stirling engine unit 90 and a second Stirling engine unit 92, each of which are similar to the Stirling engine A as illustrated in FIG. 1 of the drawings. However, in the case of the Stirling engine A′, each engine unit 90 and 92 includes an engine block 94 and an associated crankcase 96 which are rotated 90° so that they effectively lie on their sides. In the arrangement as illustrated, the expander portions of each of the units are disposed above the displacer portions. The engine unit 90 is provided with an expander cylinder 97 and a displacer cylinder 98 disposed therebeneath. Disposed within the expander cylinder 97 is a reciprocatively shiftable expander piston 100, and, in like manner, disposed within the displacer cylinder 98 is a reciprocatively shiftable displacer piston 102. The pistons 100 and 102 are each respectively provided with an expander piston rod 104 and a displacer piston rod 106.

The piston rods 104 and 106 would each normally extend through a seal block, similar to the seal blocks 36 and 56, and would terminate at and be connected to a cross-head, similar to the cross-heads 26 and 46, although not specifically shown in FIGS. 6 and 7.

The expander piston rod 104 is connected to an expander crankshaft 108 through a connecting arm 110 and a crank arm 112 which are located in the crankcase 96, much in the same manner as the piston rod 23 was connected to the expander circuit 34. In like manner, the piston rod 106 is connected to a displacer crankshaft 114 through a connecting arm 116 and a crank arm 118, in the manner as illustrated in FIG. 7 of the drawings.

The engine unit 92 is substantially identical to the engine unit 90 and also includes an expander cylinder 97' and a displacer cylinder 98', along with the reciprocatively shiftable expander piston 100' and the reciprocatively shiftable displacer piston 102', respectively. These pistons are similarly provided with an expander piston rod 104' and a displacer piston rod 106' which are respectively connected to the expander crankshaft 108 and the displacer crankshaft 114 through the same connecting rod and crank arm linkages.

In accordance with the above-outlined construction, it can be observed that two opposed expander pistons 100 and 100' operate on and cause rotation of the expander crankshaft 108. In like manner, a pair of opposed displacer pistons 102 and 102' are operatively connected to the displacer crankshaft 114 and are rotatable therewith. The expander crankshaft is provided with an expander synchronizing gear 120 and the displacer crankshaft is provided with a displacer synchronizing gear 122 which is rotatable therewith.

The synchronization gears 120 and 122 in each of these Stirling engine sections 90 and 92 mesh with a single idler gear 124 and which is connected to a common power output shaft 126, the latter of which extends outwardly from the Sterling engine A', in the manner as illustrated in FIG. 6 of the drawings. In this case, the synchronization gears 120 and 122 would have the same size and the same number of teeth so as to prevent any unauthorized phase change between the displacer portion and the expander portion of the engine in each of the Stirling engine sections 90 and 92.

For purposes of simplicity and clarity, the heat exchangers have not been shown in FIGS. 6 and 7, although it should be understood that a separate heat exchanger would be used with each engine unit 90 and 92. Moreover, for this purpose, the engine block 94 is provided with ducts 128 and 130 communicating with the expander cylinder 97 and the displacer cylinder 98, respectively. In like manner, the engine block 94' of the engine unit 92 is provided with ducts 128' and 130' which communicate with the expander cylinder 97' and the displacer cylinder 98'. Each of these ducts are provided for connection to a suitable heat exchanger in a conventional manner.

This form of engine construction permits high power multi-piston engines to be constructed with the banks of the displacer pistons acting on a common crankshaft and the banks of the expander pistons similarly acting on a common crankshaft. Moreover, this engine construction inherently can be compact and rigid using current design practices. In addition, the power output and the direction of rotation of the power output shaft can be easily controlled by adjusting the phase angle between the two crankshafts. This type of phase angle adjustment can be accomplished with the differential type gear arrangement as disclosed in the aforesaid co-pending patent application. Again, this engine construction could also employ two crankshafts rotating in opposite directions to substantially reduce or eliminate gyroscopic forces as previously described.

FIGS. 8 and 9 more fully illustrate a Stirling engine A" which comprises a first bank 140 of Stirling engine units 142 and 142', each of which are substantially identical to the Stirling engine units 90 and 92 and are connected in a vertically disposed arrangement in the manner as illustrated. In addition, the Stirling engine A" is comprised of a laterally spaced second bank 144 having opposed Stirling engine units 146 and 146', which, again, are substantially identical to the previously described Stirling engine units 90 and 92.

FIG. 9 more fully illustrates the details of each Stirling engine unit 146 and 146' and each is provided with expander cylinders 148 and 148' having shiftable pistons 150 and 150' with reciprocatively shiftable piston rods 152 and 152', respectively. Each of these expander pistons cooperate with and are connected to an expander crankshaft 154. The two Stirling engine units 146 and 146' would each have a displacer section similarly constructed so as to operate on a displacer crankshaft. The displacer crankshaft is not shown in FIG. 9 since it lies immediately beneath the expander crankshaft 154. The expander crankshaft 154 is provided with an expander synchronizing gear 158 and the displacer crankshaft is provided with a displacer synchronizing gear (not shown) which, in turn, mesh with an idler gear 162, the latter of which rotates a power output shaft 164.

The bank 140 which includes the Stirling engine units 142 and 142' are similarly provided with expander cylinders 166 snd 166' having reciprocatively shiftable expander pistons 168 and 168' located therein. Each of these pistons 168 and 168' similarly drive expander piston rods 170 and 170' which, in turn, are connected to the same expander crankshaft 154. In like manner, the displacer portions of each of the two Stirling engine 142 and 142' would have displacer pistons operating upon and rotating with the displacer crankshaft.

Thus, in the Stirling engine A", the expander portions will all lie above the displacer portions in each of the banks of Stirling engine units. Here, again, it is only necessary to employ one pair of synchronizing gears, one for each of the crankshafts, and one idler gear 162 which operates upon the common putput power shaft 164. However, it should be understood that other forms of synchronizing the two crankshafts could be employed in the manner as previously described. This construction of the Stirling engine A" is also highly beneficial in that it increases the power output of the engine without significantly increasing the overall size of the Stirling engine.

FIG. 10 more fully illustrates a Stirling engine construction A'" which is comprised of two of the Stirling engine units A" illustrated in FIGS. 8 and 9 of the drawings. In this case, the power output shaft 164 of each of the engines is connected through a conventional gearing or differential 180 having two main power output shafts 182 and 184. In this way, it is possible to provide power output shafts which rotate in opposite directions.

This form of Stirling engine construction is highly desirable where it is desired to simultaneously obtain power output from the engine in two different directions. Moreover, a suitable phase angle change device could be included in the gearing or differential 180 in order to change the phase relationship between the two power output shafts 182 and 184. The two engine units A" could be constructed so that the power output shafts 164 both rotate in the opposite directions. This construction also permits the power output of the engine to be relatively free of gyroscopic forces, in the manner as previously described.

This multiple unit engine construction, as for example, the construction illustrated in FIGS. 6 and 7, permits the engine units to be laid on their side so that a pair of opposed engine units can operate on a pair of crankshafts. Moreover, this form of construction eliminates the rather high and narrow engine construction of the multi-piston hot gas engines of the prior art. In many multi-piston Stirling engines, one piston of the engine had to be 90° out of phase with the preceding piston. Thus, many of these hot gas engines had no means to vary the phase angle and the engine could only operate in a positive power output mode, or otherwise with a reverse power output only and with other means of changing the power output. Due to the construction of the present invention, the units more nearly resemble the cubular design form and, thus, are compact and have a configuration where they can be used in a standard automotive vehicle engine compartment. In addition, the engines of the present invention can be constructed so that gyroscopic forces present in high speed engines of this type can be substantially reduced or eliminated.

In addition to the above, the engines of the present invention do not present the problem of balancing which is inherent in essentially all prior art Stirling-type engines. In addition, this engine construction is such that common parts can be used in each engine and in each bank of the engine units. Moreover, unlike the prior art constructions, it is possible to use standard crankshafts of conventional construction.

The power output of any Stirling engine is a function of the piston stroke and cylinder volume. In many of the current Stirling engine designs, the power stroke is fairly long due to the constraint on the size and configuration of the engine. Due to this long piston stroke, these Stirling engine designs are relatively slow in their operation. However, in accordance with the present invention, the piston stroke can be much shorter which enables a much higher speed of operation of the Stirling engine than was available in prior art Stirling engine designs.

Thus, there has been illustrated and described a unique and novel Stirling engine using dual crankshafts and which can be assembled in multiple units, and which fulfills all of the objects and advantages sought therefor. It should be understood that many changes, modifications, variations and other uses and applications will become apparent to those skilled in the art after considering this specification and the accompanying drawings. Therefore, any and all such changes, modifications, variations and other uses and applications which do not depart from the spirit and scope of the invention are deemed to be covered by the invention which is limited only by the following claims.

Having thus described my invention, what I desire to claim and secure by letters patent is:

1. A hot gas engine comprising:

(a) an engine block, (b) a displacer cylinder in said engine block and having central axis and with a shiftable displacer piston therein, (c) an expander cylinder in said engine block and having central axis and with a shiftable expander piston therein, (d) a heat exchange means connected across said displacer cylinder and expander cylinder, (e) a crankcase on one end portion of said engine block and located so as to communicate with ends of the expander and displacer cylinders, said engine block having a dimension measured along the central axis of said cylinder which is substantially greater than the like dimension of said crankcase, said engine block not being sealed from said crankcase against substantial pressure differential, (f) a first crankshaft in said crankcase operatively connected to said shiftable displacer piston and being rotatable therewith, (g) a second crankshaft in said crankcase operatively connected to said shiftable expander piston and being rotatable thereby, (h) first coupling means on said first crankshaft, (i) second coupling means on said second crankshaft, and (j) a power output shaft operatively coupled to one of said coupling means or one of said crankshafts and providing a power output from said hot gas engine.

2. The hot gas engine of claim 1 wherein said second crankshaft is disposed in a generally parallel plane with said first crankshaft.

3. The hot gas engine of claim 1 wherein said power output shaft is provided with a third coupling means in operative engagement with said first and second coupling means.

4. The hot gas engine of claim 3 wherein said first and second coupling means each comprises a coupling element respectively rotatable with said first and second crankshafts and said third coupling means comprises a third coupling element which is rotatable with said first and second coupling elements and causes rotation of said power output shaft with said first and second coupling elements.

5. The hot gas engine of claim 4 wherein said first and second coupling elements are gears and said third coupling element is a gear in meshing engagement with said first and second gears.

6. The hot gas engine of claim 5 wherein said third gear is an idler gear.

7. The hot gas engine of claim 1 wherein said first and second coupling means are gears which are disposed in operative meshing engagement and said power output shaft is connected to one of said first or second crankshafts.

8. The hot gas engine of claim 1 wherein continuous belt means extends between said first and second and third coupling means.

9. A hot gas engine comprising:

(a) an engine block with an expander cylinder and a displacer cylinder, (b) an expander piston shiftable in said expander cylinder, (c) a displacer piston shiftable in said displacer cylinder, (d) heat exchange means connected across said expander cylinder and displacer cylinder, (e) a crankcase on one end portion of said engine block and located so as to communicate with ends of the expander and displacer cylinders, said engine block having a dimension measured along the central axis of said cylinders which is substantially greater than the like dimension of said crankcase, (f) an expander crankshaft and a displacer crankshaft in said crankcase, (g) first connecting means operatively connecting said expander piston to said expander crankshaft, (h) second connecting means operatively connecting said displacer piston to said displacer crankshaft, (i) seal means in said cylinders to prevent oil in said crankcase from passing into said expander cylinder and displacer cylinder and said heat exchange means, said seal means being effective to maintain said expander cylinder and displacer cylinder and heat exchange means and crankcase at substantially the same average pressure to permit operation throughout the engine at substantially the same average pressure and thereby avoid the need for dynamic seals, and (j) an output power shaft operatively connected to at least one of said crankshafts to provide a power output from said engine.

10. The hot gas engine of claim 9 wherein a crosshead is located in each of said expander cylinder and displacer cylinder to maintain alignment of the piston rods and reduce side loads therefrom.

11. The hot gas engine of claim 9 wherein the seal means comprises a seal block and a sealing element therein which is in a relatively dry state and prevents oil passage therebetween but does not substantially seal against large pressure differential thereacross.

12. A hot gas engine comprising:

(a) an engine block, (b) a displacer cylinder in said engine block having a central axis and with a shiftable displacer piston therein, (c) an expander cylinder in said engine block and having a central axis and with a shiftable expander piston therein, (d) a heat exchange means connected across said displacer cylinder and expander cylinder, (e) a crankcase on one end portion of said engine block and located so as to communicate with ends of the exapnder cylinder and the displacer cylinder, said engine block having a dimension as measured along the central axis of said cylinder which is substantially greater than the like dimension of said crankcase, (f) an expander piston rod connected to and being movable with said expander piston, (g) a displacer piston rod connected to and being movable with said displacer piston, (h) a first connecting member at one end of said expander piston rod and being shiftable therewith and being designed to reduce side load forces, (i) a first connecting rod connected to said first connecting member, (j) a second connecting member at one end of said displacer piston rod and being shiftable therewith and being designed to reduce side load forces, (k) a second connecting rod connected to said second connecting member, (l) seal means in each of said cylinders to prevent oil in said crankcase from passing into said expander cylinder and displacer cylinder and said heat exchange means, said seal means being effective to maintain said expander cylinder and displacer cylinder and heat exchange means and crankcase at substantially the same pressure to permit operation throughout the engine at substantially the same pressure and thereby avoid the need for dynamic seals, (m) a first crankshaft in said crankcase operatively connected to said shiftable displacer piston through said second connecting rod and being rotatable thereby, (n) a second crankshaft in said crankcase operatively connected to said shiftable expander piston through said first connecting rod and being rotatable thereby, said second crankshaft being generally parallel to said first crankshaft, (o) first coupling means on said first crankshaft, (p) second coupling means on said second crankshaft, and (q) a power output shaft operatively coupled to at least one of said coupling means or one of said crankshafts and providing a power output from said hot gas engine.

13. The hot gas engine of claim 12 wherein said power output shaft is provided with a third coupling means in operative engagement with said first and second coupling means.

14. The hot gas engine of claim 13 wherein said first and second coupling means each comprises a coupling element respectively rotatable with said first and second crankshafts and said third coupling means comprises a third coupling element which is rotatable with said first and second coupling elements and causes rotation of said power output shaft with said first and second coupling elements.

15. The hot gas engine of claim 14 wherein said first and second coupling elements are gears and said third coupling element is a gear in meshing engagement with said first and second gears.

16. The hot gas engine of claim 15 wherein said third gear is an idler gear.

* * * * *